US008340542B2

(12) United States Patent
Yoshida

(10) Patent No.: US 8,340,542 B2
(45) Date of Patent: Dec. 25, 2012

(54) IMAGE FORMING APPARATUS FOR IMPROVING TRANSFER EFFICIENCY AND PREVENTING IMAGE DETERIORATION

(75) Inventor: Ken Yoshida, Chigasaki (JP)

(73) Assignee: Ricoh Company, Limited, Tokyo (JP)

( * ) Notice: Subject to any disclaimer, the term of this patent is extended or adjusted under 35 U.S.C. 154(b) by 325 days.

(21) Appl. No.: 12/758,223

(22) Filed: Apr. 12, 2010

(65) Prior Publication Data

US 2010/0266300 A1 Oct. 21, 2010

(30) Foreign Application Priority Data

Apr. 16, 2009 (JP) ..... 2009-099699
Jul. 13, 2009 (JP) ..... 2009-164476
Feb. 5, 2010 (JP) ..... 2010-024137

(51) Int. Cl.
*G03G 15/16* (2006.01)

(52) U.S. Cl. ..... 399/66; 399/341

(58) Field of Classification Search ..... 399/39, 399/66, 341
See application file for complete search history.

(56) References Cited

U.S. PATENT DOCUMENTS 5,075,186 A * 12/1991 Sheridon ..... 430/47.1
5,926,679 A * 7/1999 May et al. ..... 430/44.1
7,003,238 B2 2/2006 Yoshida et al.
7,162,179 B2 1/2007 Yoshida
7,203,433 B2 4/2007 Kato et al.
7,280,792 B2 10/2007 Sawai et al.
7,542,713 B2 6/2009 Yoshida
7,610,004 B2 10/2009 Kato et al.
7,639,976 B2 12/2009 Yoshida
2008/0088883 A1 4/2008 Yoshida
2008/0279589 A1 11/2008 Muto et al.
2008/0317518 A1* 12/2008 Fukuhara ..... 399/302
2009/0016784 A1 1/2009 Yoshida
2009/0196661 A1 8/2009 Yoshida
2010/0080631 A1 4/2010 Ogiyama et al.

FOREIGN PATENT DOCUMENTS

JP 1-134485 5/1989
JP 5-281863 10/1993
JP 10-55089 2/1998
JP 2002-236392 8/2002
JP 2003-162125 6/2003
JP 2004-279664 10/2004
JP 2004-354623 12/2004
JP 2006-139180 6/2006
JP 2006-251717 9/2006
JP 2007-155963 6/2007
JP 2008-139589 6/2008

* cited by examiner

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

An image forming apparatus including multiple colored toner image forming units to form multiple colored toner images on a rotatable body, a transfer device to collectively transfer the multiple colored toner images onto a recording medium from the rotatable body, a fixing device to fix the multiple colored toner images onto the recording medium, and a light-colored toner image forming unit to form a light-colored toner image as a bottommost layer of a resultant full-color toner image formed on the rotatable body. The multiple colored toner images are sequentially superimposed on the light-colored toner image formed as the bottommost layer of the resultant full-color toner image formed on the rotatable body. A condition for forming the light-colored toner image by the light-colored toner image forming unit is set such that the light-colored toner image is not transferred onto the recording medium from the rotatable body by the transfer device.

17 Claims, 8 Drawing Sheets

IMAGE FORMING APPARATUS FOR IMPROVING TRANSFER EFFICIENCY AND PREVENTING IMAGE DETERIORATION

CROSS-REFERENCE TO RELATED APPLICATIONS

The present patent application is based on and claims priority pursuant to 35 U.S.C. §119 from Japanese Patent Application Nos. 2009-099699, filed on Apr. 16, 2009, 2009-164476, filed on Jul. 13, 2009, and 2010-024137, filed on Feb. 5, 2010, all in the Japan Patent Office, each of which is incorporated herein by reference in its entirety.

BACKGROUND OF THE INVENTION

1. Field of the Invention

Exemplary aspects of the present invention generally relate to an image forming apparatus such as a copier, facsimile machine, and printer, and more particularly to an image forming apparatus in which color toner images formed on an image carrier or an intermediate transfer body are collectively transferred onto a recording medium.

2. Description of the Background

Related-art image forming apparatuses, such as copiers, printers, facsimile machines, and multifunction devices having two or more of copying, printing, and facsimile functions, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

One example of widely-used image forming apparatuses includes a tandem-type image forming apparatus having multiple image carriers. Colored toner images formed respectively on surfaces of the multiple image carriers are sequentially transferred onto an intermediate transfer body of the transfer device in a superimposed manner to form a full-color toner image on the intermediate transfer body. The full-color toner image thus formed is then transferred onto a recording medium from the intermediate transfer body.

Transfer efficiency of the full-color toner image from the intermediate transfer body onto the recording medium is not 100% in such a tandem-type image forming apparatus, and consequently residual toner adheres to the surfaces of the image carriers and the intermediate transfer body, adversely affecting image density and leading to unnecessary consumption of toner. In particular, a toner image of a specific color formed on the intermediate transfer body as the bottommost layer of the full-color toner image, which consists as described above of superimposed multiple layers of color toner images, tends to remain on the intermediate transfer body. Specifically, adherence of the toner image to the intermediate transfer body prevents the toner image from being transferred onto the recording medium when the full-color toner image is transferred onto the recording medium from the intermediate transfer body. Consequently, a desired color is not achieved in a resultant image formed on the recording medium, causing a deterioration in color reproducibility. Thus, improvement of transfer efficiency of the full-color toner image is demanded.

In order to improve transfer efficiency of the full-color toner image, for example, Published Unexamined Japanese Patent Application Nos. H01-134485, H05-281863, 2002-236392, 2003-162125, and 2006-251717 respectively disclose techniques in which a clear toner image is formed underneath a colored toner image so that the clear toner image is the bottommost layer of a full-color toner image formed on either an image carrier or an intermediate transfer body. Accordingly, the clear toner image formed as the bottommost layer of the full-color toner image remains on the image carrier or the intermediate transfer body when the full-color toner image is transferred onto a recording medium, thereby achieving transfer efficiency approaching 100% of the colored toner image.

In another approach, a clear toner image is formed for the purpose of imparting glossiness to a resultant color image. Specifically, the clear toner image is superimposed on a colored toner image formed on a recording medium to impart glossiness to the resultant color image, thereby achieving color reproducibility like that obtained by photoprinting and so forth. For example, Published Unexamined Japanese Patent Application No. H10-055089 (hereinafter referred to as JP-H10-055089-A) discloses a technique in which a clear toner image is formed underneath a colored toner image so that the clear toner image is the bottommost layer of a full-color toner image formed on an intermediate transfer body. The clear toner image is then transferred onto a recording medium together with the colored toner image so that the clear toner image is formed on the colored toner image on the recording medium.

In a case in which the clear toner image is formed in order to improve transfer efficiency of the full-color toner image as described above, although a part of the clear toner image remains on the intermediate transfer body, the other part of the clear toner image is inadvertently transferred onto the recording medium together with the colored toner image. As a result, the clear toner image is superimposed on the colored toner image on the recording medium. As mentioned above, in this case, the clear toner image is formed not for the purpose of imparting glossiness to the resultant color image as disclosed in JP-H10-055089-A but for improving transfer efficiency of the full-color toner image. Consequently, the clear toner image superimposed on the colored toner image may alter the glossiness or color of the resultant color image from those desired by a user, thereby degrading image quality.

Such deterioration in image quality can be prevented if clear toner that can impart the same degree of glossiness as that of colored toner after being fixed onto the recording medium, or clear toner including fewer impurities, is used for forming the clear toner image to prevent changes in a color of the resultant color image. However, the range of materials available for use in such clear toner is limited, and moreover incurs a cost increase due to removal of impurities therefrom.

Further, in a case in which thick toner layers are transferred onto the recording medium, it is known that toner of a smaller electrostatic force included in an upper portion of the toner layers tends to scatter when subjected to an electric field applied by the transfer device to the toner layers, more often causing irregular images due to toner scattering within the image forming apparatus. In addition, when the thick toner layers are transferred onto the recording medium, heat is not sufficiently applied to all the toner layers in the fixing device, and consequently, the toner image is not appropriately fixed onto the recording medium. A total amount of toner or a thickness of the toner layers to be transferred onto the recording medium is increased particularly in a case in which a full-color toner image formed by superimposing colored toner images of yellow, magenta, cyan, and black one atop the other on the intermediate transfer body is transferred onto the recording medium. Consequently, toner scattering and deterioration in fixing performance tend to occur due to the thick toner layers. Moreover, because formation of the clear toner image as the bottommost layer of the full-color toner image on the intermediate transfer body increases the total amount of toner, toner scattering and deterioration in fixing performance more easily occur.

To solve the above-described problems, a technique for reducing the amount of colored toner is widely known. Specifically, a threshold value to limit the total amount of toner transferred onto the recording medium is set so as to reduce the amount of colored toner when the total amount of all toner, clear and colored, exceeds the threshold value. However, a desired color may not be achieved in a resultant color image if the amount of colored toner is simply reduced. Therefore, a method called under color removal (UCR) is used. In the UCR method, a portion of a toner image where toner of yellow, magenta, and cyan are superimposed one atop the other is converted into a toner image of black, and then the amounts of toner of yellow, magenta, and cyan are reduced. However, an increase in such a portion to be converted into the toner image of black in the UCR method adversely affects color reproducibility. Further, because the total amount of toner is further increased in a case in which the clear toner image is formed as the bottommost layer of the full-color toner image as described above, the threshold value is easily exceeded, thereby more often triggering restriction of the total amount of toner. Consequently, although it might be expected that formation of the clear toner image as the bottommost layer of the full-color toner image improves transfer efficiency of the colored toner image and provides higher image quality with superior color reproducibility, in fact the resultant color image has inferior color reproduction.

It is to be noted that the above-described problems may also occur in image forming apparatuses in which a clear toner image is formed underneath a colored toner image as the bottommost layer of a full-color toner image on an image carrier that transfers the full-color toner image onto a recording medium.

SUMMARY

In view of the foregoing, illustrative embodiments of the present invention provide an image forming apparatus in which an additional toner image is formed underneath a colored toner image as the bottommost layer of a full-color toner image on an image carrier or an intermediate transfer body to improve transfer efficiency of the colored toner image from the image carrier or the intermediate transfer body onto a recording medium. The additional toner image formed as the bottommost layer of the full-color toner image prevents image deterioration and provides full-color images of higher quality.

In one illustrative embodiment, an image forming apparatus includes multiple colored toner image forming units to form multiple colored toner images on a rotatable body, a transfer device to collectively transfer the multiple colored toner images onto a recording medium from the rotatable body, a fixing device to fix the multiple colored toner images onto the recording medium, and a light-colored toner image forming unit provided upstream from the multiple colored toner image forming units in a direction of rotation of the rotatable body to form a light-colored toner image having a color lighter than colors of the multiple colored toner images as a bottommost layer of a resultant full-color toner image formed on the rotatable body. The multiple colored toner images respectively formed by the multiple colored toner image forming units are sequentially superimposed on the light-colored toner image formed by the light-colored toner image forming unit as the bottommost layer of the resultant full-color toner image formed on the rotatable body. A condition for forming the light-colored toner image by the light-colored toner image forming unit is set such that the light-colored toner image is not transferred onto the recording medium from the rotatable body by the transfer device.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
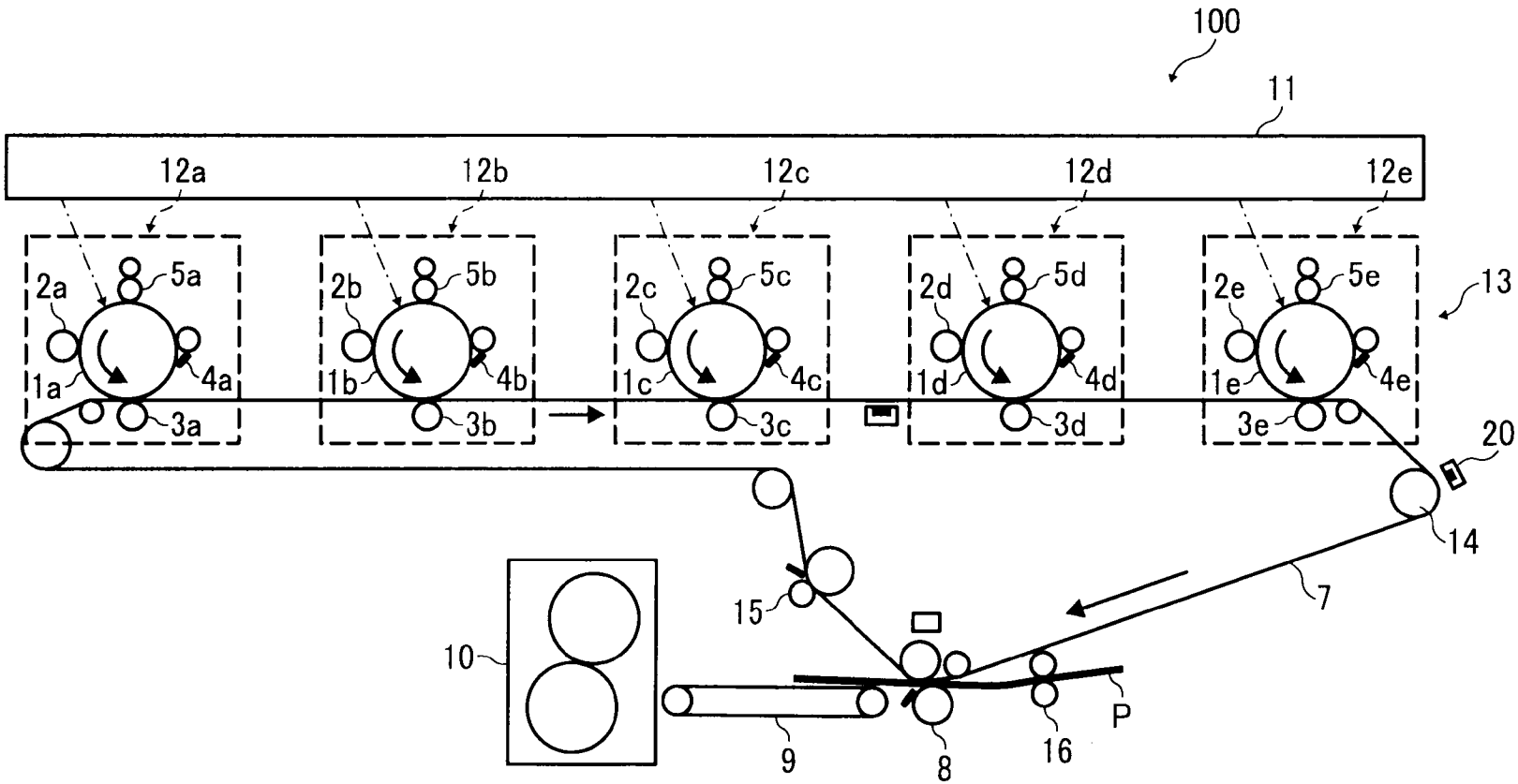
FIG. 1 is a schematic view illustrating a configuration of main components of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

A description is now given of a configuration of a full-color image forming apparatus employing an electrophotographic method and serving as an image forming apparatus 100 according to a first illustrative embodiment. FIG. 1 is a schematic view illustrating a configuration of main components of the image forming apparatus 100 according to the first illustrative embodiment. The image forming apparatus 100 includes an image writing device 11, an image forming device 13, a sheet feeder, not shown, a discharging device, not show, and so forth. The image forming device 13 includes image forming units 12*b*, 12*c*, 12*d*, and 12*e* each serving as a colored toner image forming means for forming a toner image of a specific color, that is, yellow (Y), magenta (M), cyan (C), or black (K), arranged in parallel to one another. Specifically, the image forming apparatus 100 is a tandem-type image forming apparatus in which the colored toner images of yellow, magenta, cyan, and black formed by the respective image forming units 12*b*, 12*c*, 12*d*, and 12*e* are superimposed one atop the other to form a full-color toner image. The image forming apparatus 100 further includes an image forming unit 12*a* provided upstream from the image forming units 12*b*, 12*c*, 12*d*, and 12*e* in a direction of rotation of an intermediate transfer belt 7 to form a clear toner image. It is to be noted that the image forming units 12*a*, 12*b*, 12*c*, 12*d*, and 12*e* are hereinafter collectively referred to as image forming units 12.

The intermediate transfer belt 7 serving as a rotatable body is provided facing photoconductive drums 1*a*, 1*b*, 1*c*, 1*d*, and 1*e* each serving as a rotatable body (hereinafter collectively referred to as photoconductive drums 1) respectively included in the image forming units 12. The intermediate transfer belt 7 is wound around multiple rollers including a drive roller 14, and is rotatable in a clockwise direction in FIG. 1. Primary transfer rollers 3*a*, 3*b*, 3*c*, 3*d*, and 3*e* (hereinafter collectively referred to as primary transfer rollers 3) that transfer the toner images respectively formed on surfaces of the photoconductive drums 1 onto the intermediate transfer belt 7 are provided facing the photoconductive drums 1 with the intermediate transfer belt 7 interposed therebetween. Specifically, the primary transfer rollers 3 sequentially transfer the toner images respectively formed by the image forming units 12 onto the intermediate transfer belt 7 in a superimposed manner to form a full-color toner image on the intermediate transfer belt 7.

A secondary transfer device 8 that transfers the full-color toner image formed on the intermediate transfer belt 7 onto a recording medium such as a sheet P is provided downstream from the primary transfer rollers 3 in the direction of rotation of the intermediate transfer belt 7. Further, a belt cleaning device 15 that removes residual toner adhering to the intermediate transfer belt 7 is provided downstream from the secondary transfer device 8 in the direction of rotation of the intermediate transfer belt 7.

The sheet feeder, not shown, that feeds the sheet P to a pair of registration rollers 16 is provided at the bottom of the image forming apparatus 100. The pair of registration rollers 16 feeds the sheet P to a position where the intermediate transfer belt 7 and the secondary transfer device 8 face each other in synchronization with the full-color toner image formed on the intermediate transfer belt 7. Accordingly, the full-color toner image formed on the intermediate transfer belt 7 is transferred onto the sheet P by the secondary transfer device 8. The sheet P having the transferred full-color toner image thereon is then conveyed to a fixing device 10 by a conveyance device 9. In the fixing device 10, heat and pressure are applied to the sheet P to fix the full-color toner image onto the sheet P. Thereafter, the sheet P having the full-color image thereon is discharged from the image forming apparatus 100.

It is to be noted that each of the image forming units 12 has the same configuration and performs the same operation, differing only in the color of toner used. Specifically, the image forming units 12 respectively include chargers 5*a*, 5*b*, 5*c*, 5*d*, and 5*e* (hereinafter collectively referred to as chargers 5), developing devices 2*a*, 2*b*, 2*c*, 2*d*, and 2*e* (hereinafter collectively referred to as developing devices 2), cleaning devices 4*a*, 4*b*, 4*c*, 4*d*, and 4*e* (hereinafter collectively referred to as cleaning devices 4), and so forth, around the photoconductive drums 1. The toner images of the respective colors are formed on the surfaces of the respective photoconductive drums 1 using the well-known electrophotographic image forming method.

Figure 2:
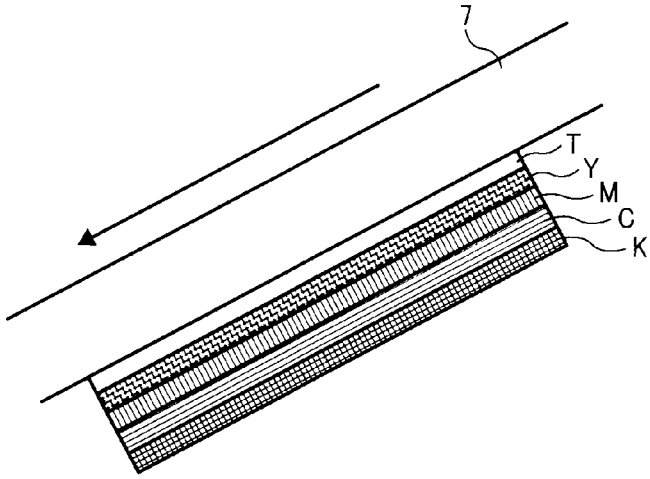
FIG. 2 is a schematic view illustrating a structure of a full-color toner image formed on an intermediate transfer belt.

In the image forming apparatus 100, first, a clear toner image T formed on the surface of the photoconductive drum 1*a* in the image forming unit 12*a* is transferred onto the intermediate transfer belt 7 by the primary transfer roller 3*a*. In other words, the clear toner image T is formed immediately on the intermediate transfer belt 7 as the bottommost layer of a full-color toner image to be formed. Subsequently, the colored toner images respectively formed on the surfaces of the photoconductive drums 1*b*, 1*c*, 1*d*, and 1*e* are sequentially transferred onto the clear toner image T formed on the intermediate transfer belt 7 and are superimposed one atop the other in order from yellow to magenta, cyan, and black to form the full-color toner image. FIG. 2 is a schematic view illustrating a structure of the full-color toner image formed on the intermediate transfer belt 7 as described above. As shown in FIG. 2, the clear toner image T, the yellow toner image Y, the magenta toner image M, the cyan toner image C, and the black toner image K are superimposed one atop the other, in that order, on the intermediate transfer belt 7. Needless to say, a color not to be formed in a resultant image is not included in the full-color toner image thus formed.

Figure 3:
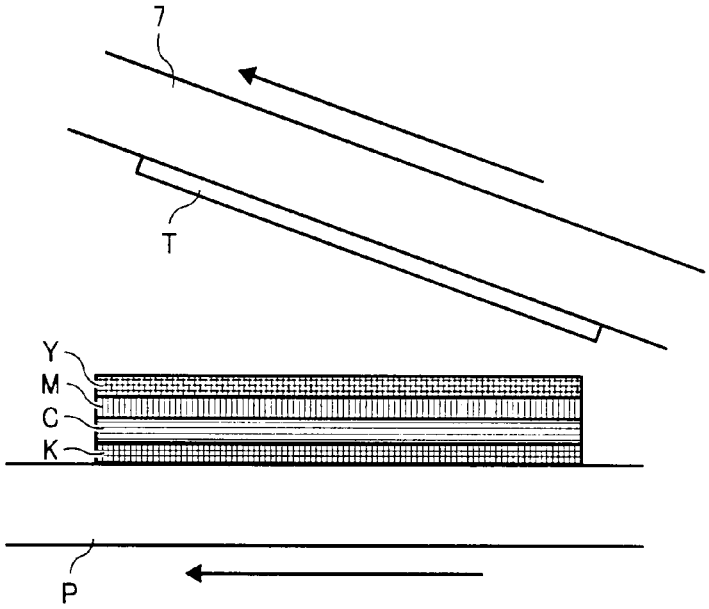
FIG. 3 is a schematic view illustrating a structure of a full-color toner image formed on a recording medium.

FIG. 3 is a schematic view illustrating a structure of the full-color toner image formed on the sheet P. In the secondary transfer device 8, the full-color toner image formed on the intermediate transfer belt 7 and the sheet P are pressed against each other within an electric field, so that the full-color toner image is transferred onto the sheet P from the intermediate transfer belt 7. At this time, in general, the full-color toner image is not fully transferred onto the sheet P from the intermediate transfer belt 7, and consequently, some of the toner is not transferred but remains on the intermediate transfer belt 7. However, because the clear toner image T is formed as the bottommost layer of the full-color toner image on the intermediate transfer belt 7 as described above, most of the toner not transferred but remaining on the intermediate transfer belt 7 is a part of the clear toner image T. Accordingly, the colored toner images, that is, the toner images of yellow (Y), magenta (M), cyan (C), and black (K), are substantially fully transferred onto the sheet P.

Figure 4:
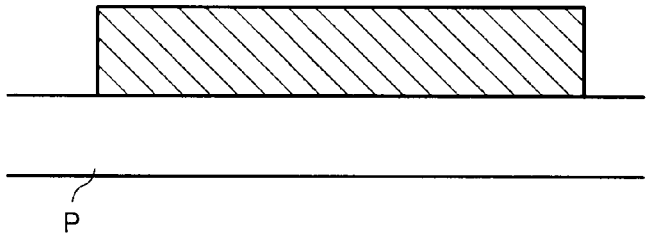
FIG. 4 is a schematic view illustrating a structure of a toner image fixed onto the recording medium after passing through a fixing device.

It is to be noted that the toner images of black (K), cyan (C), magenta (M), and yellow (Y) are transferred onto the sheet P and superimposed one atop the other, in that order, on the sheet P as illustrated in FIG. 3. The sheet P having the full-color toner image thereon is then conveyed to the fixing device 10 by the conveyance device 9. In the fixing device 10, heat and pressure are applied to the sheet P so that the colored toner images are melted and fixed onto the sheet P as illustrated in FIG. 4.

However, if the clear toner image T formed as the bottommost layer of the full-color toner image on the intermediate transfer belt 7 is transferred onto the sheet P together with the colored toner images of yellow (Y), magenta (M), cyan (C), and black (K), undesired glossiness may be imparted to the resultant image, degrading color reproducibility. In addition, transfer of the clear toner image T onto the sheet P increases a total amount of toner transferred onto the sheet P, possibly causing toner scattering and poor fixing performance. Further, in a case in which the total amount of toner transferred onto the sheet P is restricted for a large proportion of the full-color toner image, color reproducibility may deteriorate. However, if there is not enough clear toner of the clear toner image T, transfer efficiency is degraded.

To solve the above-described problems, in the image forming apparatus 100 according to the first illustrative embodiment, the image forming unit 12*a* forms the clear toner image T such that the clear toner image T formed as the bottommost layer of the full-color toner image on the intermediate transfer belt 7 is not transferred by the secondary transfer device 8 onto the sheet P. Specifically, an amount of the clear toner transferred onto the intermediate transfer belt 7 is controlled when forming the clear toner image T.

It is to be noted that the color of the toner used for forming the clear toner image T by the image forming unit 12*a* is not limited solely to clear toner, and thus, for example, toner of a lighter color may be used. The reason is that, as described in detail later, in principle the clear toner image T formed by the image forming unit 12*a* is not transferred onto the sheet P according to the first illustrative embodiment. However, because there is a possibility that a slight amount of the clear toner image T may be transferred onto the sheet P, the color of the clear toner image T needs to be lighter to make that color invisible when being fixed onto the sheet P, as described in detail below.

First, a method for adjusting the amount of the clear toner or the light-colored toner transferred onto the intermediate transfer belt 7 is described in detail. Although the clear toner or the light-colored toner used in the first illustrative embodiment becomes substantially or completely invisible when melted and fixed onto the sheet P in the fixing device 10, the above-described toner before the fixing process has a color that can be detected by well-known optical sensors. Accordingly, the amount of the clear toner or the light-colored toner transferred onto the intermediate transfer belt 7 can be adjusted by a well-known technology described below. It is to be noted that the light-colored toner which becomes invisible after being fixed onto the sheet P is prepared by eliminating colorants therefrom using a generally-used method also described in detail later.

Because the amount of the toner transferred onto the intermediate transfer belt 7 is proportional to a size of a developing potential, it can be controlled by adjusting image forming conditions such as the power of a laser diode (LD) that emits laser light from the image writing device 11, the size of a charging bias of the chargers 5, and the size of a developing bias of the developing devices 2. However, because the proportion of the amount of the toner transferred onto the intermediate transfer belt 7 and the size of the developing potential is changed due to changes in an amount of charge of the toner and so forth, image density control is performed as follows. Specifically, a gradation pattern including multiple toner patches for density detection formed under different image forming conditions such as different developing potentials is formed such that the toner patches have different amounts of toner, respectively. The amount of toner of each toner patch is calculated using values detected by a reflective optical sensor serving as an optical detection means and a predetermined algorithm for calculating the amount of toner. Based on a relation between the amount of the toner of the toner patch and the image forming conditions such as the developing potential, a developing value $\gamma$ and development starting voltage Vk are obtained. It is to be noted that the developing value $\gamma$ is a slope of a line and the development starting voltage Vk is an intercept, where a horizontal axis represents the developing potential and a vertical axis represents the amount of toner. The image forming conditions such as the sizes of the LD, the charging bias, and the developing bias are adjusted to provide the developing potential that provides an appropriate amount of toner based on the developing value $\gamma$ thus obtained.

A regular-reflection type optical sensor is generally used for detecting the toner patches. The regular-reflection type optical sensor includes a light emitting element such as an LED and a light receiving element such as a phototransistor, and detects regular reflective light emitted from the light emitting element using the light receiving element. In the regular-reflection type optical sensor, the amount of the regular reflective light is increased when a surface to be detected (hereinafter referred to as a detection surface) is flat. Accordingly, output from the light receiving element is high when the detection surface is flat. By contrast, the amount of the regular reflective light is decreased as the detection surface is rougher. Accordingly, the output from the light receiving element is low when the detection surface is rough. In other words, when the amount of toner attached to the intermediate transfer belt 7 is small, a large amount of light is reflected from the flat surface of the intermediate transfer belt 7. As a result, an amount of the regular reflective light is increased, and the output from the light receiving element is high. On the other hand, when the amount of toner attached to the intermediate transfer belt 7 is large, the amount of the regular reflective light is reduced because the detection surface is rough due to accumulation of toner particles. As a result, the output from the light receiving element is low. Thus, there is an inverse relation between the output from the light receiving element and the amount of toner, and accordingly, the amount of toner can be detected based on the output from the light receiving element.

However, the regular-reflection type optical sensor may not accurately detect the amount of toner of the toner patch at a high concentration portion, that is, where an amount of toner of 0.3 mg or greater is attached for each portion of 1 $cm^2$. The reason is that there is little difference between a light rough state in which toner particles almost cover the intermediate transfer belt 7 and a heavy rough state in which more toner particles adhere and accumulate to form multiple toner layers on the intermediate transfer belt 7.

An example of an optical sensor that detects an amount of toner at a high concentrate portion of the toner patch includes two light receiving elements that respectively receive regular reflective light and diffuse reflective light. Image forming apparatuses employing such an optical sensor (or a reflective optical sensor) are disclosed in, for example, Published Unexamined Japanese Patent Application Nos. 2006-139180, 2004-279664, and 2004-354623.

In the first illustrative embodiment, the above-described reflective optical sensor including the two light receiving elements is used to detect an amount of the colored toner at a high concentration portion in the full-color toner image, where an amount of toner of 0.3 mg or greater is attached for each portion of 1 $cm^2$ based on the amounts of regular reflective light and diffuse reflective light detected. When an amount of the clear toner or the light-colored toner is 10% or less of the amount of the colored toner, the reflective optical sensor is used to detect the amount of the clear toner or the light-colored toner based on a detection value of the regular reflective light. Although the single reflective optical sensor is used to detect the amounts of the colored toner and the clear toner (or the light-colored toner) according to the first illustrative embodiment, alternatively, multiple optical sensors may be used. In such a case, a reflective optical sensor capable of detecting both the regular reflective light and the diffuse reflective light is used for detecting the amount of the colored toner, and an optical sensor capable of detecting the regular reflective light is used for detecting the amount of the clear toner or the light-colored toner.

In the image forming device 13 illustrated in FIG. 1, a reflective optical sensor 20 serving as an image density detector is provided above the drive roller 14 to output a signal corresponding to an optical reflectance on the intermediate transfer belt 7.

Figure 5:
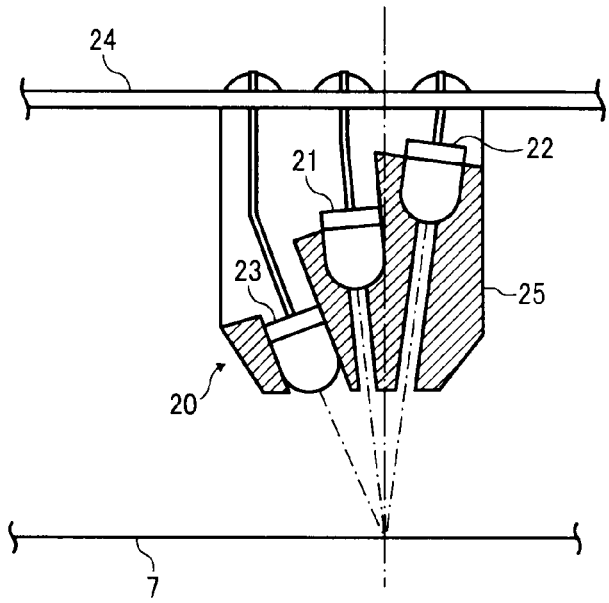
FIG. 5 is a vertical cross-sectional view illustrating a configuration of a reflective optical sensor included in the image forming apparatus illustrated in FIG. 1.

FIG. 5 is a vertical cross-sectional view illustrating a configuration of the reflective optical sensor 20 included in the image forming apparatus 100 according to the first illustrative embodiment. The reflective optical sensor 20 includes a light emitting element 21 serving as a light emitting means, a regular reflective light receiving element 22 serving as a first light receiving means for receiving regular reflective light, and a diffuse reflective light receiving element 23 serving as a second light receiving means for receiving diffuse reflective light. The elements 21, 22, and 23 are installed on a printed substrate 24, and are enclosed within a single package 25. In the package 25, an incident light path through which light emitted from the light emitting element 21 passes to the intermediate transfer belt 7, and a regular reflective light path through which a regular reflective light reflected from the intermediate transfer belt 7 passes to the regular reflective light receiving element 22, are formed.

It is determined whether adjustment of the amount of toner is needed or not when the image forming apparatus 100 is turned on or a printing operation is started. Adjustment of the amount of toner is performed when needed. Because a period of time to heat a heater provided within the fixing device 10 and to prepare a print controller is needed, and usage environment may be changed while the image forming apparatus 100 is turned off, the amount of toner may be adjusted immediately after the image forming apparatus 100 is turned on.

Figure 6:
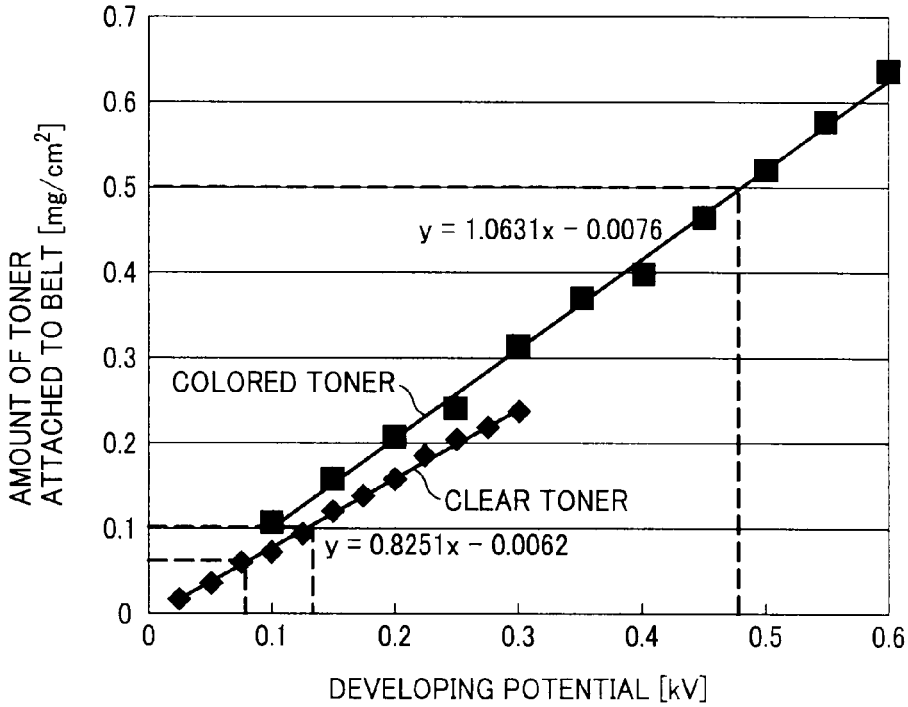
FIG. 6 is a graph showing a relation between a developing potential and an amount of toner attached to the intermediate transfer belt.

FIG. 6 is a graph showing results of measurement of the amount of toner in the gradation pattern performed as described above. Approximate straight lines are calculated using the results to obtain linear equations for the amount of toner and the developing potential that are calculated as shown in FIG. 6. For example, as shown in FIG. 6, a developing potential of 477 V is required to attach colored toner of a density of 0.5 mg/$cm^2$ to the intermediate transfer belt 7. In a case in which an amount A of the clear toner attached to the intermediate transfer belt 7 is 10% of the total amount of toner attached to the intermediate transfer belt 7, the amount A of the clear toner is about 0.056 mg/$cm^2$, obtained by $(0.5+A)\times 0.1=A$ when single colored toner is used. At this time, the developing potential is set to 75 V based on the linear equation. By contrast, when multiple colored toners are used, the amount A of the clear toner is about 0.111 mg/$cm^2$, obtained by $(0.5\times 2+A)\times 0.1=A$. At this time, the developing potential is set to 142 V based on the linear equation.

The amounts of the colored toner and the clear toner attached to the intermediate transfer belt 7 may be slightly changed during continuous printing operations. In such a case, in addition to adjustment of the amount of toner as described above, a toner patch is formed between toner images, that is, between print ranges, and an amount of toner of the toner patch is detected by the reflective optical sensor 20 to adjust the toner density based on the result thus detected. Accordingly, the amount of toner can be reliably controlled and set to a target amount. When the amount of toner of the toner patch thus detected is smaller than the target amount, an adjustment is made to supply additional toner. Conversely, when the amount of toner of the toner patch thus detected is larger than the target amount, the amount of toner supplied is reduced. Thus, the amount of toner can be finely adjusted.

In the first illustrative embodiment, the amount of the clear toner attached to the intermediate transfer belt 7 is adjusted to be 10% of the total amount of toner attached to the intermediate transfer belt 7. Accordingly, the amounts of the clear toner and the colored toner attached to the intermediate transfer belt 7 are respectively adjusted as shown in Table 1 below using the above-described adjustment method. Each of the letters A, B, C, and D in Table 1 represents a portion in the full-color toner image formed on the intermediate transfer belt 7. As shown in Table 1, the amounts of the colored toner are different for the portions A, B, C, and D, and the amounts of the clear toner for the portions A, B, C, and D differ depending on the total amount of the colored toner. Further, the amounts of the clear toner at the portions A, B, C, and D are set to be 10% of the total amount of toner, that is, a sum of the amounts of the colored toner and the clear toner, on the intermediate transfer belt 7.

TABLE 1 unit: mg/$cm^2$

| | A | B | C | D |
|---|---|---|---|---|
| Y | 0.3 | 0.3 | 0 | 0 |
| M | 0.3 | 0.3 | 0 | 0 |
| C | 0.3 | 0.3 | 0 | 0.2 |
| K | 0.3 | 0 | 0.5 | 0 |
| Amount of Colored Toner | 1.2 | 0.9 | 0.5 | 0.2 |
| Amount of Clear Toner | 0.133 | 0.100 | 0.056 | 0.022 |
| Total Amount of Toner on Belt | 1.33 | 1.00 | 0.56 | 0.22 |

At the portion A in Table 1, the amounts of toner of yellow (Y), magenta (M), and cyan (C) are set to exceed a total toner restriction value, described below, and therefore a part of the toner of yellow (Y), magenta (M), and cyan (C) is converted into the toner of black (K) such that the total amount of toner of yellow (Y), magenta (M), cyan (C), and black (K) does not exceed the total toner restriction value.

In general, the total toner restriction value is set to be about 200% to 260% of the maximum amount of toner for any single color. Specifically, the total toner restriction value is a proportion related to the maximum amount of each of the colored toners, that is, the toner of yellow (Y), magenta (M), cyan (C), and black (K). Assuming that the maximum amount of toner of any single color is 0.5 mg/cm$^2$, the total toner restriction value is set in a range between 1.0 mg/cm$^2$ and 1.3 mg/cm$^2$, since 0.5×2=1.0 and 0.5×2.6=1.3.

It is to be noted that the maximum amount of toner of any single color differs depending on design concepts of image forming apparatuses such as target image density. Further, the maximum acceptable amount of toner of any single color also differs depending on the capabilities of the fixing devices and on toner characteristics.

According to the first illustrative embodiment, the total toner restriction value is set to be 240% of the maximum amount of toner for any single color, that is, 1.2 mg/cm$^2$. At the portion B in Table 1, toner of yellow (Y), magenta (M), and cyan (C) are superimposed one atop the other within a range not exceeding the total toner restriction value. The portion C in Table 1 is a solid portion of the toner image of the single color, and the portion D in Table 1 is a halftone portion of the toner image of the single color.

Figure 7:
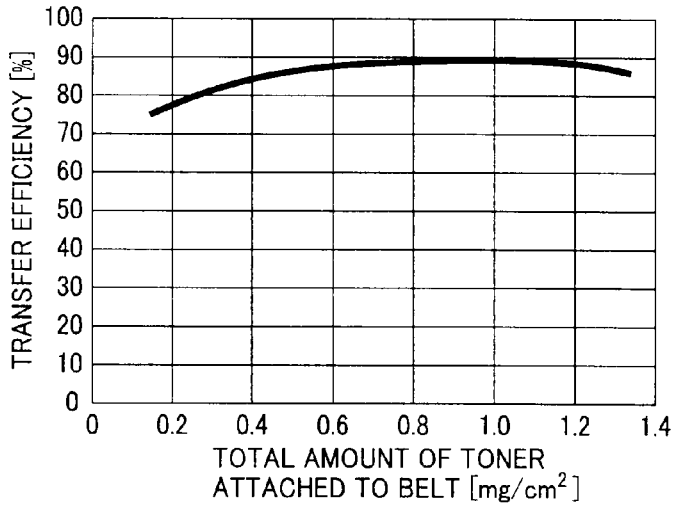
FIG. 7 is a graph showing a relation between a total amount of toner attached to the intermediate transfer belt and transfer efficiency.

In an experiment, the total amount of toner attached to the intermediate transfer belt 7 was adjusted as described above, and the amount of toner adhering to the intermediate transfer belt 7 before and after the full-color toner image is transferred onto the sheet P was measured. FIG. 7 is a graph showing results of transfer efficiency obtained based on a relation between the amounts of toner attached to the intermediate transfer belt 7 before and after the full-color toner image is transferred onto the sheet P from the intermediate transfer belt 7.

Figure 8:
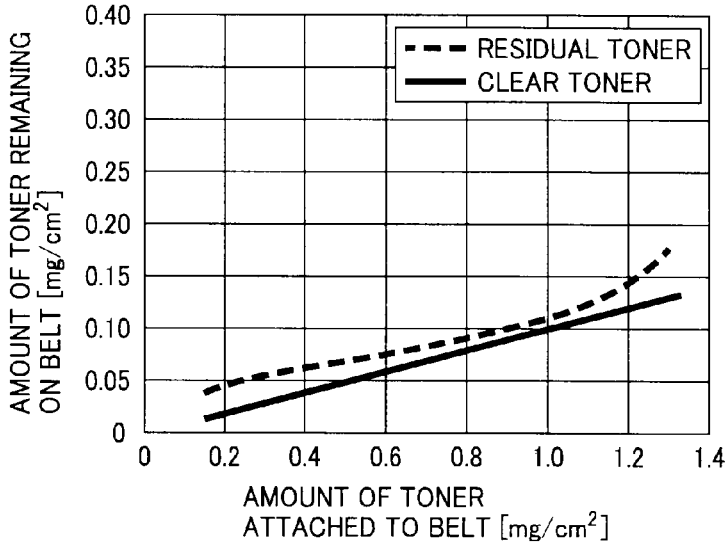
FIG. 8 is a graph showing a relation between an amount of clear toner and the total amount of toner attached to the intermediate transfer belt before and after the full-color toner image is transferred onto the recording medium.

FIG. 8 is a graph showing a relation between the amount of the clear toner before and after the full-color toner image is transferred onto the sheet P and the amount of residual toner adhering to the intermediate transfer belt 7 after the full-color toner image is transferred onto the sheet P in a case in which the amount of the clear toner attached to the intermediate transfer belt 7 is adjusted to be 10% of the total amount of toner attached to the intermediate transfer belt 7. As shown in FIG. 8, the amount of the clear toner remaining on the intermediate transfer belt 7 is always slightly smaller than the amount of residual toner remaining on the intermediate transfer belt 7 after the full-color toner image is transferred onto the sheet P. In other words, the clear toner is not transferred onto the sheet P from the intermediate transfer belt 7. Accordingly, it is found that the clear toner is not transferred onto the sheet P from the intermediate transfer belt 7 when the amount of the clear toner attached to the intermediate transfer belt 7 is adjusted to be 10% or less of the total amount of toner attached to the intermediate transfer belt 7.

Also as shown in FIG. 8, the amount of residual toner remaining on the intermediate transfer belt 7 is slightly larger than the amount of the clear toner remaining on the intermediate transfer belt 7 after the full-color toner image is transferred onto the sheet P. In other words, all or most of the clear toner remains on the intermediate transfer belt 7 after the full-color toner image is transferred onto the sheet P. It was confirmed that most of the residual toner remaining on the intermediate transfer belt 7 after the full-color toner image is transferred onto the sheet P was the clear toner.

Figure 9:
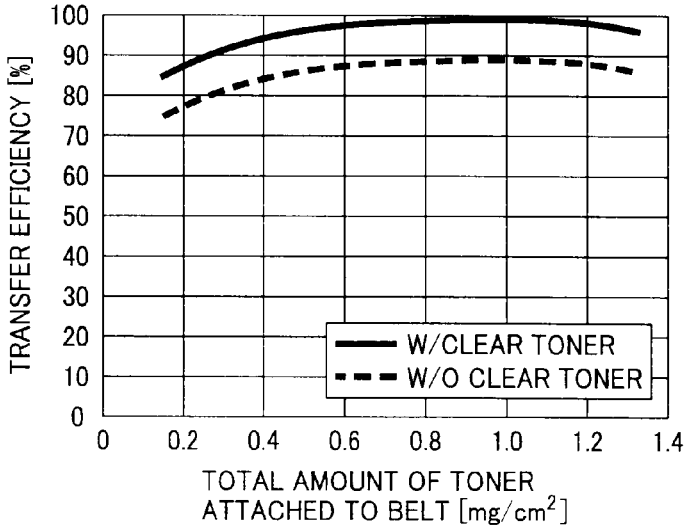
FIG. 9 is a graph showing improvement in transfer efficiency of colored toner when clear toner is used.

From the results shown in FIG. 8, it is contemplated that the amount of the colored toner included in the residual toner is obtained by excluding the amount of the clear toner from the amount of residual toner. Transfer efficiency of the colored toner when the clear toner is used can be obtained from a comparison of the amount of the colored toner remaining on the intermediate transfer belt 7 after the full-color toner image is transferred onto the sheet P and the amount of the colored toner attached to the intermediate transfer belt 7 before the full-color toner image is transferred onto the sheet P. FIG. 9 is a graph showing a comparison between transfer efficiency of the colored toner when the clear toner is used and when the clear toner is not used. As shown in FIG. 9, the transfer efficiency of the full-color toner image is increased considerably by using the clear toner.

During the above-described measurements, white spots caused by irregular transfer of the full-color toner image occurred at a small portion of the sheet P. Table 2 below sorts levels of irregular transfer occurring when the clear toner is used or not used into 5 ranks from Ranks 1 to 5. The lower ranks such as Ranks 1 and 2 indicate poorer evaluation results, that is, indicate irregular transfer including white spots large in amount and size. Ranks 4 and higher were deemed acceptable for evaluation purpose.

TABLE 2

| Total Amount of Toner on Belt mg/cm$^2$ | Rank: Colored Toner Only | Rank: W/Clear Toner |
|---|---|---|
| 0.15 | 2 | 4 |
| 0.22 | 3 | 5 |
| 0.32 | 3 | 5 |
| 0.44 | 4 | 5 |
| 0.56 | 4 | 5 |
| 0.7 | 5 | 5 |
| 0.84 | 5 | 5 |
| 1 | 5 | 5 |
| 1.12 | 5 | 5 |
| 1.22 | 4 | 5 |
| 1.33 | 4 | 5 |

As shown in Table 2, in a case in which the clear toner is not used, irregular transfer occurs when the total amount of toner on the intermediate transfer belt 7 is lower. However, in a case in which the clear toner is used, irregular transfer does not occur because transfer efficiency of the colored toner is improved. It is to be noted that, although a result obtained when the total amount of toner attached to the intermediate transfer belt 7 is less than 0.15 mg/cm$^2$ is not shown, a lower toner density causes white spots that are actually generated in the resultant color image to be less noticeable. Accordingly, the evaluation rank for that case is not low.

A description is now given of the image forming conditions described above according to the first illustrative embodiment.

Each of the photoconductive drums 1 includes an organic photoconductive drum. The intermediate transfer belt 7 includes a carbon-dispersed polyimide, and has a volume resistivity of $10^9$ Ω·cm$^3$ and a surface resistivity of $10^{11}$ Ω/cm$^2$. Each of the primary transfer rollers 3 includes a hydrin foam rubber roller and has a resistivity of $10^7$Ω. A primary transfer bias of 30 μA is applied to each of the primary transfer rollers 3. A roller of the secondary transfer device 8 provided within an inner circumference of the intermediate transfer belt 7 includes a hydrin rubber roller and has a resistivity of $10^8\Omega$, and a secondary transfer bias of −40 μA is applied to the roller. The other roller of the secondary transfer device 8 provided at an outer circumference of the intermediate transfer belt 7 includes a hydrin NBR rubber roller and has a resistivity of $10^6\Omega$. A density of toner of each color is 7 percentage by weight, and an amount of charge of the toner of each color is in a range between −20 μC/g and −30 μC/g. Image formation is performed at a process speed of 280 mm/sec, and the sheet P having a smoothness of 20 sec is used.

The light-colored toner used as the clear toner in the first illustrative embodiment is produced by eliminating colorants from the well-known colored toner. Although the toner having an average particle diameter of 6.8 μm produced by a pulverization method is used in the first illustrative embodiment, alternatively, a generally known method in which binder resins and additives are melted and kneaded and then the resultant product is pulverized and classified, or generally known polymerization methods such as suspension, dispersion, or emulsion may be used for manufacturing the toner. The toner may include inorganic fine particles to have fluidity. Examples of the inorganic fine particles include, but are not limited to, generally known silica particles of which surfaces are hydrophobized, composite metal oxides such as silica particles doped with other metal, silica particles coated with metals or metal oxides, titanium oxides, aluminum oxides, and silicon carbides. The light-colored toner used in the first illustrative embodiment includes hydrophobic silica and titanium oxides. Any of the well-known colored toner may be used as the colored toner used together with the light-colored toner in the first illustrative embodiment.

As described above, the amount of the clear toner or the light-colored toner is adjusted such that the clear toner image T formed as the bottommost toner layer of the full-color toner image on the intermediate transfer belt 7 is not transferred onto the sheet P according to the first illustrative embodiment. As a result, image deterioration can be prevented. When the clear toner is used, the color of the clear toner needs to be lighter than a predetermined degree to make the clear toner invisible when the clear toner is fixed onto the sheet P. Consequently, as compared to the light-colored toner, a cost increase is inevitable for the clear toner in order to remove impurities that cause opacity of the toner and to include expensive resins and additives. By contrast, because a certain number of impurities is acceptable and more options for the resins and the additives are available, the light-colored toner can achieve a cost reduction compared to the clear toner. However, when the amount of the light-colored toner transferred onto the sheet P exceeds a predetermined amount, the light-colored toner is visible when being fixed onto the sheet P. Consequently, the light-colored toner is not used for imparting glossiness to the resultant color image or for forming tint blocks and so forth on the sheet P. Therefore, the light-colored toner is used only for improving transfer efficiency of the colored toner, and is not allowed to be transferred onto the sheet P.

It is to be noted that although a tandem-type full-color image forming apparatus in which multiple image forming units are arranged in parallel to one another is used as the image forming apparatus 100 according to the first illustrative embodiment, a full-color image forming apparatus including a single photoconductive drum and multiple developing devices in which colored toner images are sequentially transferred onto an intermediate transfer body in a superimposed manner and are further transferred onto a recording medium may be used as the image forming apparatus 100. Further alternatively, the first illustrative embodiment is applicable to an image forming apparatus in which toner images of respective colors are sequentially superimposed one atop the other on a single photoconductive drum and are transferred onto a recording medium from the photoconductive drum. Regardless of types of the image forming apparatuses, the same effects described above can be provided as long as the clear toner image T is formed as the bottommost layer of the full-color toner image and the colored toner images are formed on the clear toner image T.

A description is now given of a second illustrative embodiment of the present invention. A configuration and operations of the image forming apparatus 100 according to the second illustrative embodiment are the same as those according to the first illustrative embodiment except that a sheet re-feeding device 30 is provided to the image forming apparatus 100 according to the second illustrative embodiment. A configuration of the sheet re-feeding device 30 is to be described in detail later.

In the second illustrative embodiment, the clear toner which becomes invisible after being fixed onto the sheet P is used. There are two image forming conditions set for forming the clear toner image T by the image forming unit 12*a* in the second illustrative embodiment. Specifically, in a first clear toner image forming condition (hereinafter referred to as a first condition), the clear toner image T is formed on the intermediate transfer belt 7 such that the clear toner image T is not transferred onto the sheet P from the intermediate transfer belt 7 by the secondary transfer device 8. On the other hand, in a second clear toner image forming condition (hereinafter referred to as a second condition), the clear toner image T is formed on the intermediate transfer belt 7 such that the clear toner image T is transferred onto the sheet P from the intermediate transfer belt 7 by the secondary transfer device 8. The first and second conditions are selectable.

As described previously, in the first illustrative embodiment, because the clear toner image T inadvertently superimposed on the colored toner images on the sheet P may cause image deterioration, the clear toner image T is caused not to be transferred onto the sheet P in order to prevent changes in a degree of glossiness and color of a resultant color image. However, there may be demand for causing the clear toner image T to be transferred onto the sheet P to impart glossiness to the resultant color image and to level a surface of the resultant color image. Further, formation of tint blocks or watermarks using the clear toner may be demanded. To meet such demand, the first condition in which the clear toner image T is caused not to be transferred onto the sheet P and the second condition in which the clear toner image T is caused to be transferred onto the sheet P are selectable in the second illustrative embodiment, thereby providing a wide variety of functions and desired images.

The amount of the clear toner attached to the intermediate transfer belt 7 differs between the first and second conditions. A description is now given of the first condition with reference to FIGS. 2, 3, and 4, and the second condition with reference to FIGS. 10, 11, and 12 to compare with each other.

In the first condition, the amount of the clear toner used for forming the clear toner image T by the image forming unit 12*a* is adjusted such that the clear toner image T is not transferred onto the sheet P from the intermediate transfer belt 7. Specifically, in the same manner as the first illustrative embodiment, the clear toner image T, the yellow toner image Y, the magenta toner image M, the cyan toner image C, and the black toner image K are superimposed one atop the other, in that order, on the intermediate transfer belt 7 to form the full-color toner image as illustrated in FIG. 2. When the full-color toner image is transferred from the intermediate transfer belt 7 to the sheet P by the secondary transfer device 8, the clear toner image T is not transferred onto the sheet P and remains on the intermediate transfer belt 7. Accordingly, the full-color toner image in which the black toner image K, the cyan toner image C, the magenta toner image M, and the yellow toner image Y are superimposed one atop the other in that order is formed on the sheet P as illustrated in FIG. 3. Thereafter, the sheet P having the full-color toner image thereon is conveyed to the fixing device 10 by the conveyance device 9. In the fixing device 10, heat and pressure are applied to the sheet P so that the full-color toner image is melted and fixed to form a full-color image on the sheet P as illustrated in FIG. 4.

Figure 10:
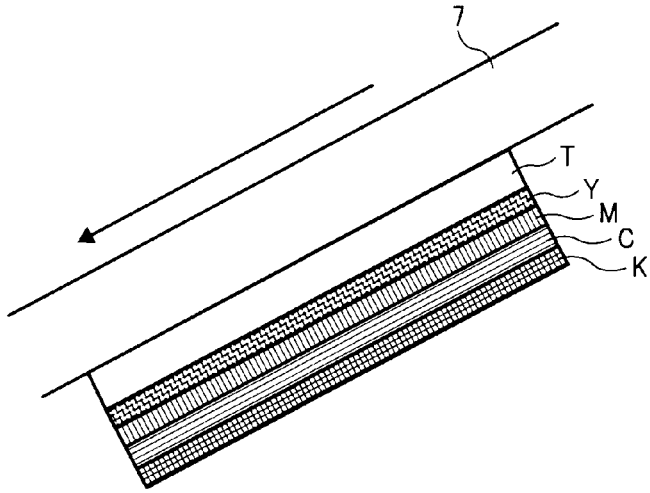
FIG. 10 is a schematic view illustrating a structure of a full-color toner image formed on the intermediate transfer belt under a second condition.
Figure 11:
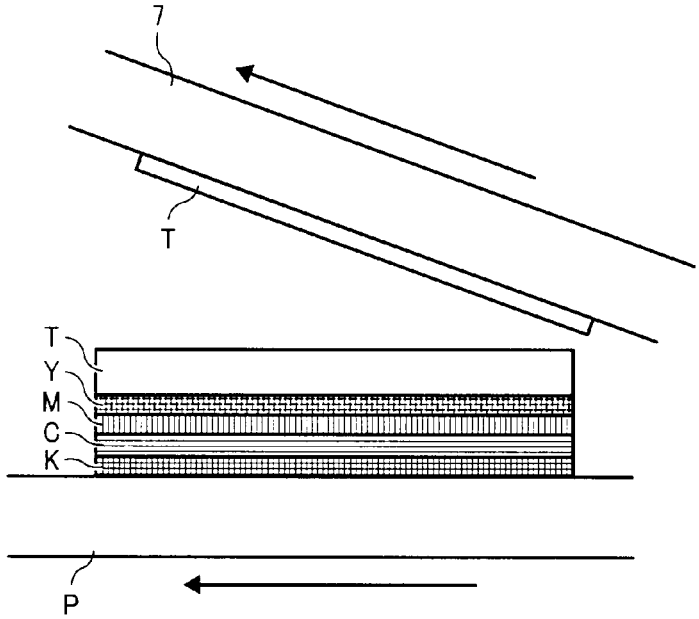
FIG. 11 is a schematic view illustrating a structure of a full-color toner image formed on the recording medium under the second condition.
Figure 12:
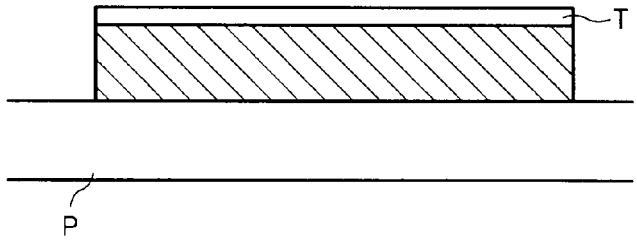
FIG. 12 is a schematic view illustrating a structure of a toner image formed under the second condition and fixed onto the recording medium after passing through the fixing device.

By contrast, in the second condition, the amount of the clear toner used for forming the clear toner image T by the image forming unit 12*a* is adjusted such that the clear toner image T is transferred onto the sheet P. FIG. 10 is a schematic view illustrating a structure of the full-color toner image formed on the intermediate transfer belt 7 under the second condition. In the same manner as the first condition described above, the clear toner image T, the yellow toner image Y, the magenta toner image M, the cyan toner image C, and the black toner image K are superimposed one atop the other, in that order, on the intermediate transfer belt 7 to form the full-color toner image as illustrated in FIG. 10. However, the amount of clear toner of the clear toner image T is larger in the second condition than that in the first condition. FIG. 11 is a schematic view illustrating a structure of the full-color toner image formed on the sheet P under the second condition. When the full-color toner image is transferred from the intermediate transfer belt 7 to the sheet P by the secondary transfer device 8, although a part of the clear toner image T is not transferred onto the sheet P and remains on the intermediate transfer belt 7, most of the clear toner image T is transferred onto the sheet P as illustrated in FIG. 11. Thereafter, the sheet P having the full-color toner image with the clear toner image T thereon is conveyed to the fixing device 10 by the conveyance device 9. In the fixing device 10, heat and pressure are applied to the sheet P so that the full-color toner image with the clear toner image T thereon is melted and fixed onto the sheet P to form a full-color image on which a layer of the clear toner is provided as illustrated in FIG. 12. Although usage of the clear toner is not particularly limited, the layer of the clear toner is used for protecting the colored toner images, imparting glossiness to the resultant color image, and so forth.

It is to be noted that, in the second condition, the clear toner image T can also be formed on a portion without the colored toner image to transfer only the clear toner image T onto the sheet P. In such a case, transfer of the clear toner image T onto the sheet P does not affect the other portion having the full-color toner image formed with the colored toner. Specifically, transfer of the clear toner image T onto the portion of the sheet P without the colored toner image reduces a difference in a degree of glossiness between the portion having the colored toner image and the portion without the colored toner image, thereby providing glossy images with higher quality as well as an improved transfer efficiency. Further, although usage of the clear toner image T is not particularly limited, the clear toner image T is used for forming tint blocks, watermarks, and so forth, on the sheet P.

For example, it is assumed that an image including a portion formed only with the colored toner image, a portion formed with the colored toner image with glossiness using the clear toner, and a watermark formed with the clear toner is formed on the sheet P. In such a case, the portion formed only with the colored toner image is formed by adjusting the amount of the clear toner attached to the intermediate transfer belt 7 under the first condition such that the clear toner image T is not transferred onto the sheet P. The portion formed with the colored toner image with glossiness using the clear toner image T is formed by adjusting the amount of the clear toner attached to the intermediate transfer belt 7 under the second condition such that the clear toner image T is transferred onto the sheet P together with the colored toner images. The watermark is formed by adjusting the amount of the clear toner attached to the intermediate transfer belt 7 under the second condition such that the clear toner image T is transferred onto the sheet P. Accordingly, a wider variety of functions are provided while improving transfer efficiency in the second illustrative embodiment, thereby providing desired images with higher quality.

In the second illustrative embodiment, as described above, it is essential to use the clear toner which becomes invisible after being fixed onto the sheet P. In other words, the light-colored toner that can be used in the first illustrative embodiment is not applicable to the second illustrative embodiment. The reason is that the light-colored toner may be visible when being fixed onto the sheet P if an amount of the light-colored toner transferred onto the sheet P exceeds a predetermined amount. Thus, the light-colored toner is not applicable for imparting glossiness to the resultant color image or providing tint blocks and so forth on the sheet P.

In a case in which the colored toner images and the clear toner image T are transferred onto the sheet P under the second condition, the total amount of toner may be increased, possibly causing irregular transfer or a deterioration in fixing performance that should be solved by the present invention. How to solve the above-described problems while proving a wider variety of functions and desired image according to the second illustrative embodiment is described in detail below. It is to be noted that, the same method as that used in the first illustrative embodiment is used for detecting and adjusting the amount of toner attached to the intermediate transfer belt 7.

As described above, in the second illustrative embodiment, the first and second conditions are selectable depending on image data included in a single image to be formed on the sheet P. The image data includes colored toner image data for forming the colored toner image, and clear toner image data for forming the clear toner image. Specifically, the colored toner image data is used for forming a color image on the sheet P, and the clear toner image data is used for imparting glossiness to a resultant image, or forming tint blocks, watermarks, and so forth on the sheet P.

Figure 13:
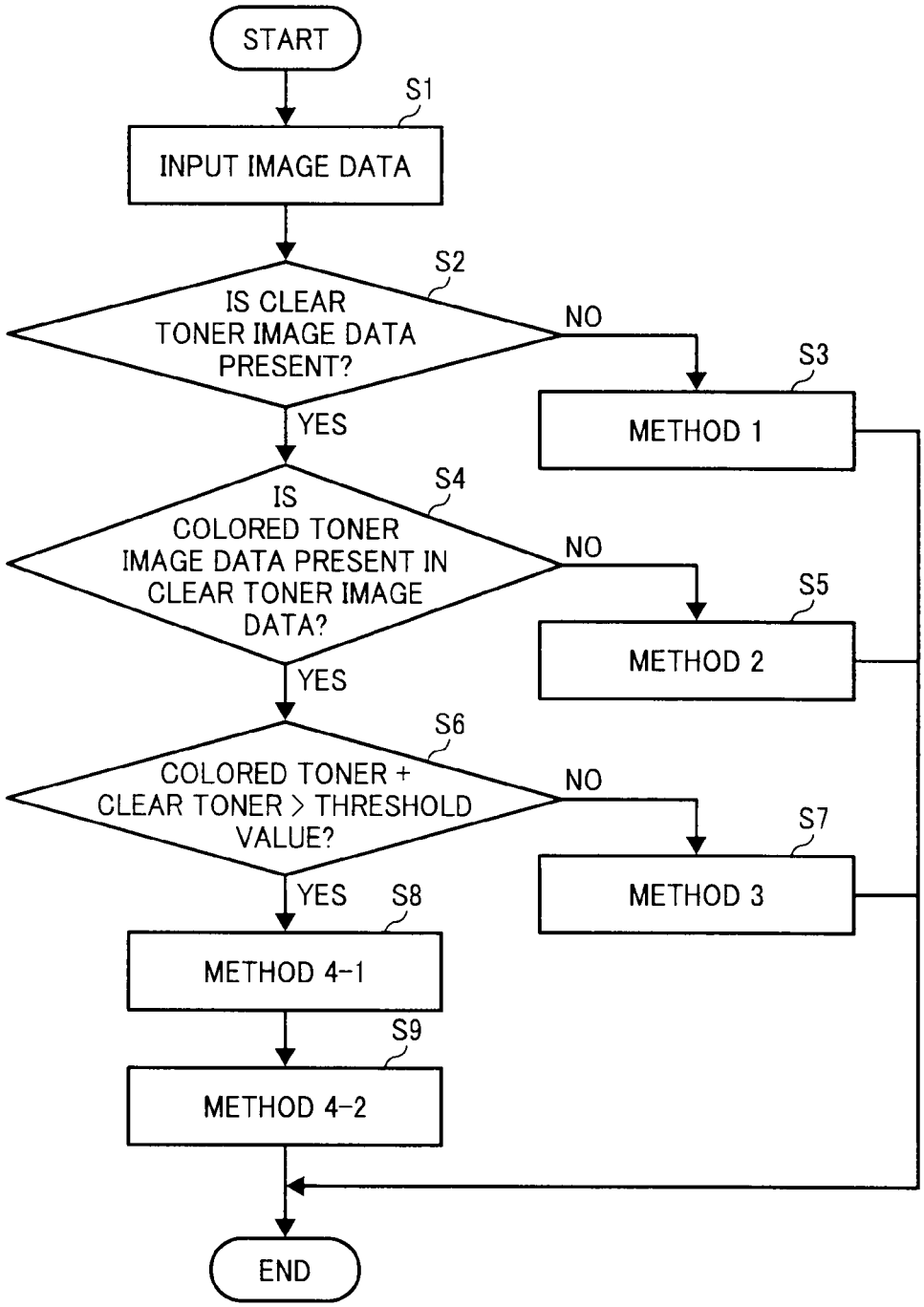
FIG. 13 is a flowchart illustrating processes to select either the first or second condition depending on image data.
Figure 14:
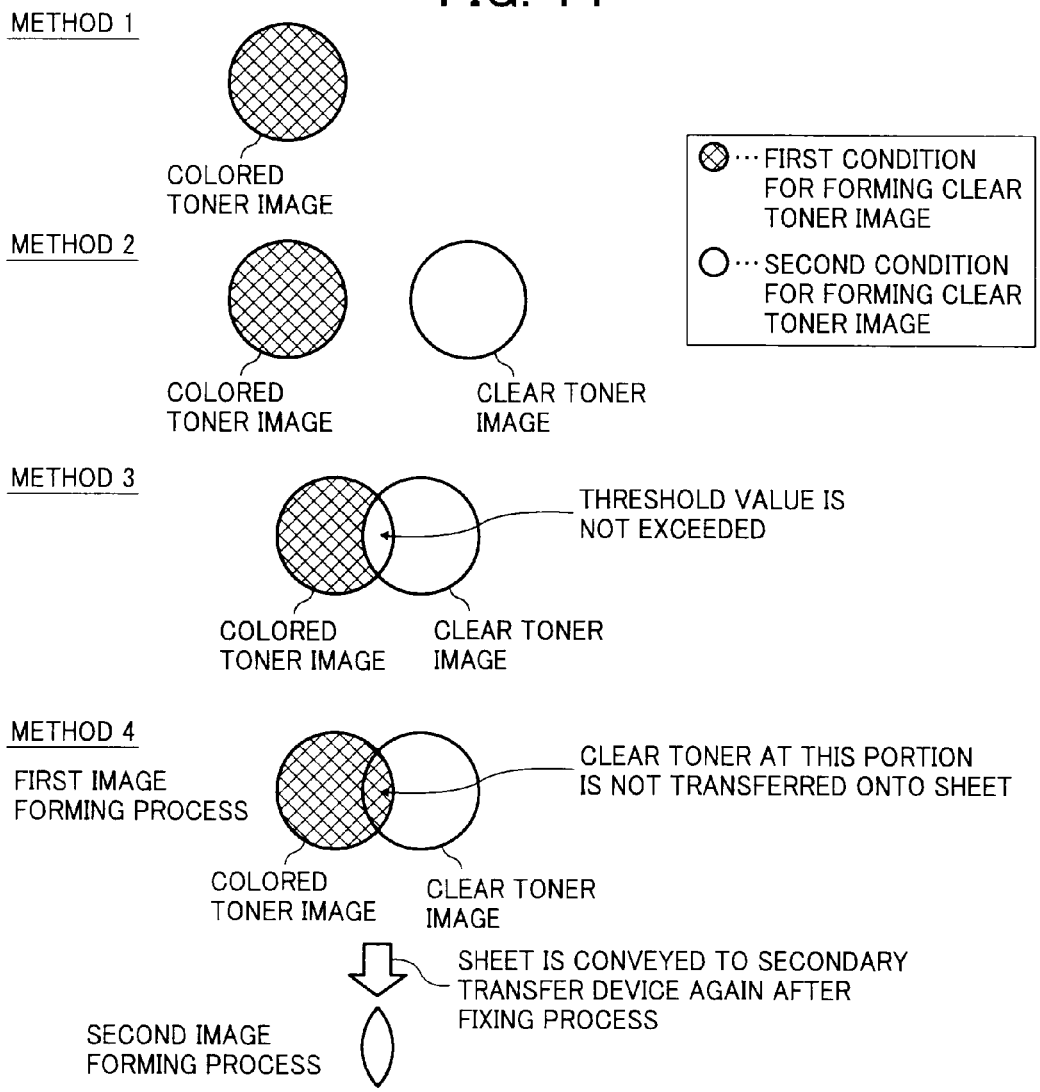
FIG. 14 is a conceptual view illustrating methods for forming images depending on image data.

FIG. 13 is a flowchart illustrating processes to determine and select either the first or second condition depending on the image data, that is, the colored toner image data or the clear toner image data. FIG. 14 is a conceptual view showing methods for forming images depending on the image data.

When image data is input at S1, at S2 it is determined whether or not clear toner image data is present. When the clear toner image data is not present (NO at S2), that is, when glossiness is not imparted to the resultant image and tint blocks, watermarks, and so forth are not formed on the sheet P, the process proceeds to S3 to select image forming method 1. In the image forming method 1, as for a portion having the colored toner image data, the clear toner image T is formed on the colored toner image under the first condition to improve transfer efficiency of the colored toner image from the intermediate transfer belt 7 onto the sheet P. The clear toner image T is not transferred onto the sheet P and remains on the intermediate transfer belt 7 in the first condition as described previously. As illustrated in the image forming method 1 in FIG. 14, the first condition is used for the portion on the sheet P having the colored toner image data to form the colored toner image on the sheet P.

By contrast, when the clear toner image data is present (YES at S2), the process proceeds to S4 to determine whether or not colored toner image data is present in the clear toner image data. When the colored toner image data is not present in the clear toner image data (NO at S4), the process proceeds to S5 to select image forming method 2. In the image forming method 2, as for the portion having the colored toner image data, the clear toner image T is formed on the colored toner image under the first condition to improve transfer efficiency of the colored toner image from the intermediate transfer belt 7 onto the sheet P. In addition, as for a portion having the clear toner image data, the clear toner image T is formed under the second condition using an amount of the clear toner corresponding to the clear toner image data. The clear toner image T thus formed under the second condition is transferred onto the sheet P, thereby imparting glossiness to a resultant image and so forth.

The reason why the image forming method 2 is performed when the colored toner image data is not present in the clear toner image data is that it is possible to form an image with an amount of toner not greater than a threshold value. As described previously, the amount of the colored toner can be restricted using the UCR method. Further, it is not necessary for the amount of the clear toner for forming the clear toner image T to exceed the amount of the colored toner. The largest amount of the clear toner is needed to impart uniform glossiness to the resultant image. Specifically, the clear toner image T is formed at a portion without the colored toner image to impart a uniform gloss achieved by imparting a uniform surface to the resultant image. In such a case, an amount of the clear toner equal to the amount of the colored toner is used to form the clear toner image T. In other words, as for a portion of the sheet P on which only the clear toner image T is formed, an amount of the clear toner not greater than the threshold value is used. Accordingly, as illustrated in the image forming method 2 in FIG. 14, the first condition is used for the portion on the sheet P having the colored toner image data to form the colored toner image on the sheet P, and the second condition is used for the portion having the clear toner image data for forming the clear toner image T on the sheet P.

When the colored toner image data is present in the clear toner image data (YES at S4), the process proceeds to S6 to determine whether or not a total amount of toner at that portion exceeds the threshold value. When the total amount of toner does not exceed the threshold value (No at S6), the process proceeds to S7 to select image forming method 3. In the image forming method 3, as for a portion having the clear toner image data, the clear toner image T is formed under the second condition using an amount of the clear toner corresponding to the clear toner image data. The clear toner image T thus formed under the second condition is transferred onto the sheet P, thereby imparting glossiness to a resultant image and so forth. As for a portion having the colored toner image data without the clear toner image data, the clear toner image T is formed on the colored toner image under the first condition to improve transfer efficiency of the colored toner image from the intermediate transfer belt 7 onto the sheet P. Further, as for a portion having the colored toner image data with the clear toner image data, the clear toner image T is formed on the colored toner image under the second condition. At this time, in the same manner as the first condition, a top layer of the full-color toner image transferred onto the sheet P is formed of the clear toner. Accordingly, transfer efficiency of the colored toner image is substantially 100%. As a result, as illustrated in the image forming method 3 in FIG. 14, the second condition is used for the portion having the clear toner image data for forming the clear toner image T on the sheet P, and the first condition is used for only the portion having the colored toner image data without the clear toner image data to form the colored toner image on the sheet P.

Figure 15:
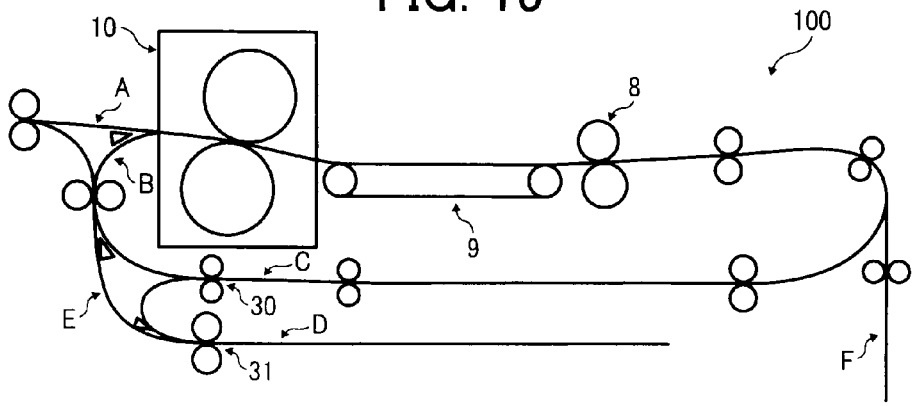
FIG. 15 is a schematic view illustrating a configuration of paths to convey the recording medium using a sheet re-feeding device included in an image forming apparatus according to a second illustrative embodiment.

FIG. 15 is a schematic view illustrating a configuration of paths to convey the sheet P using the sheet re-feeding device 30 included in the image forming apparatus 100 according to the second illustrative embodiment. As illustrated in FIG. 15, the image forming apparatus 100 according to the second illustrative embodiment further includes the sheet re-feeding device 30 that re-feeds the sheet P discharged from the fixing device 10 to the secondary transfer device 8 without reversing the sheet P. The sheet re-feeding device 30 is provided such that, when the total amount of toner exceeds the threshold value (YES at S6) in FIG. 13, the process proceeds to S8 and S9 to select image forming method 4, described below. Accordingly, transfer efficiency of the colored toner image can be improved while providing additional functions of the clear toner image T such as imparting glossiness to a resultant image without causing irregular images due to an increase in the total amount of toner.

Specifically, in the image forming method 4, as for the portion having the colored toner image data, the clear toner image T is formed on the colored toner image under the first condition so that only the colored toner image is transferred onto the sheet P from the intermediate transfer belt 7 without transferring the clear toner image T. Further, as for a portion having the clear toner image data without the colored toner image data, the clear toner image T is formed under the second condition and is transferred onto the sheet P from the intermediate transfer belt 7. At S8 in FIG. 13, the sheet P onto which the toner images formed as described above are fixed by the fixing device 10 is re-fed to the secondary transfer device 8 by the sheet re-feeding device 30. Subsequently, at S9, an additional clear toner image T is formed at a portion of the sheet P where the clear toner image T is not yet formed and is transferred by the secondary transfer device 8 onto the sheet P thus re-fed. The sheet P is then conveyed to the fixing device 10 again and the clear toner image T additionally transferred onto the sheet P is fixed onto the sheet P by the fixing device 10.

As illustrated in the image forming method 4 in FIG. 14, during the first image forming process at S8 in FIG. 13, the first condition is used for the portion having the colored toner image data to form the colored toner image on the sheet P, and the second condition is used for only the portion having the clear toner image data without the colored toner image data to form the clear toner image T on the sheet P. The toner images thus formed during the first image forming process are fixed onto the sheet P by the fixing device 10. Thereafter, during the second image forming process at S9 in FIG. 13, the second condition is used for the portion having the clear toner image data with the colored toner image data to additionally form the clear toner image T on the colored toner image already formed during the first image forming process. Accordingly, even when the colored toner image data is present in the clear toner image data and the total amount of toner at that portion exceeds the threshold value, both the colored toner image and the clear toner image T are reliably transferred onto the sheet P. As a result, additional functions of the clear toner image T such as imparting glossiness to a resultant image can be achieved.

In a case in which the colored toner image data is present in the clear toner image data, the first condition may be used for a portion where the total amount of toner exceeds the threshold value, and the second condition may be used for a portion where the total amount of toner does not exceed the threshold value. In such a case, the sheet P is still required to be re-fed to the secondary transfer device 8 by the sheet re-feeding device 30, and the same effects obtained by the image forming method 4 can be achieved.

How the sheet P is re-fed to the secondary transfer device 8 by the sheet re-feeding device 30 is described in detail with reference to FIG. 15. After the full-color toner image is fixed onto the sheet P by the fixing device 10, the sheet P is discharged from the image forming apparatus 100 through a path A. In a case in which the sheet P discharged from the fixing device 10 is re-fed to the secondary transfer device 8 without being reversed, the sheet P is conveyed to the sheet re-feeding device 30 through a path B. Subsequently, the sheet P is further conveyed to a path C by the sheet re-feeding device 30 to be re-fed to the secondary transfer device 8. In a case in which the sheet P is reversed and re-fed to the secondary transfer device 8 in duplex printing, the sheet P discharged from the fixing device 10 is conveyed to a sheet reversing device 31 through paths B and E. After conveyed to a path D to be reversed by the sheet reversing device 31, a direction of conveyance of the sheet P is reversed and the sheet P is re-fed to the secondary transfer device 8 by the sheet re-feeding device 30 through the path C. It is to be noted that a path F in FIG. 15 is used for feeding the sheet P from the sheet feeder to the pair of registration rollers 16.

In the second illustrative embodiment, when the clear toner image T is formed under the first condition such that the clear toner image T is not transferred onto the sheet P from the intermediate transfer belt 7 by the secondary transfer device 8, an amount of the clear toner attached to the intermediate transfer belt 7 is adjusted to be 10% of the total amount of toner attached to the intermediate transfer belt 7. The same method as described above in the first illustrative embodiment is used for adjusting the amount of the clear toner attached to the intermediate transfer belt 7. When the clear toner image T is formed on the intermediate transfer belt 7 by the image forming unit 12*a* under the first condition, an amount of the clear toner attached to the intermediate transfer belt 7 is set to be equal to or less than 10% of the total amount of toner attached to the intermediate transfer belt 7. As a result, the clear toner image T is not transferred onto the sheet P, and transfer efficiency of the colored toner image onto the sheet P is maximized. Although transfer efficiency is slightly changed depending on the total amount of toner attached to the intermediate transfer belt 7, because transfer efficiency of the toner image onto the sheet P is 90% or less under normal conditions, the clear toner image T is not transferred onto the sheet P as long as the amount of the clear toner attached to the intermediate transfer belt 7 is 10% or less of the total amount of toner attached to the intermediate transfer belt 7.

It is to be noted that although the tandem-type full-color image forming apparatus in which multiple image forming units are arranged in parallel to one another is used as the image forming apparatus 100 according to the second illustrative embodiment, a full-color image forming apparatus including a single photoconductive drum and multiple developing devices in which toner images are sequentially transferred onto an intermediate transfer body in a superimposed manner to transfer the full-color toner image from the intermediate transfer body to a recording medium may be used as the image forming apparatus 100. Further alternatively, the second illustrative embodiment is applicable to an image forming apparatus in which toner images of respective colors are sequentially superimposed one atop the other on a single photoconductive drum to transfer a full-color toner image from the photoconductive drum to a recording medium. Regardless of types of the image forming apparatuses, the same effects described above can be provided as long as the clear toner image T is formed as the bottommost layer of the full-color toner image and the colored toner images are formed on the clear toner image T.

A description is now given of a third illustrative embodiment of the present invention. A configuration and operations of the image forming apparatus 100 according to the third illustrative embodiment are the same as those according to the first illustrative embodiment, and descriptions thereof are omitted. The colored toner and the clear toner used in the image forming apparatus 100 according to the third illustrative embodiment include inorganic fine particles. A percentage of the inorganic fine particles included in the clear toner is smaller than that of the inorganic fine particles included in the colored toner.

As described previously, in the first illustrative embodiment, the clear toner image T formed on the intermediate transfer belt 7 is caused not to be transferred onto the sheet P together with the colored toner images in order to prevent changes in glossiness and color of a resultant color image. Further, the toner used in the first illustrative embodiment includes the inorganic fine particles to provide fluidity to the toner. However, a relation between the percentages of the inorganic fine particles respectively included in the colored toner and the clear toner is not particularly restricted in the first illustrative embodiment.

In addition to the configuration according to the first illustrative embodiment in which the amount of the clear toner attached to the intermediate transfer belt 7 is adjusted such that the clear toner image T is not transferred onto the sheet P, inorganic fine particles are included in both the colored toner and the clear toner in the third illustrative embodiment. Specifically, as described above, a percentage of the inorganic fine particles included in the clear toner is smaller than that of the inorganic fine particles included in the colored toner. As a result, the clear toner image T is more reliably prevented from being transferred onto the sheet P from the intermediate transfer belt 7, thereby reliably preventing a deterioration in glossiness and color reproducibility caused by the clear toner.

In the above description about the third illustrative embodiment, the clear toner is used to form the clear toner image T by the image forming unit 12*a* in the similar manner as the first illustrative embodiment. Alternatively, the light-colored toner may be used to form the clear toner image T by the image forming unit 12*a* according to the third illustrative embodiment. The reason is that, in the similar manner as the first illustrative embodiment, the clear toner image T formed on the intermediate transfer belt 7 by the image forming unit 12*a* is not transferred onto the sheet P in the third illustrative embodiment. Therefore, the toner used in the image forming unit 12*a* is not necessarily clear. However, because a slight amount of the clear toner image T formed by the image forming unit 12*a* may be transferred onto the sheet P from the intermediate transfer belt 7, the toner used in the image forming unit 12*a* is required to have a lighter color so that such a toner becomes invisible after being fixed onto the sheet P by the fixing device 10. The light-colored toner used in the image forming apparatus 100 according to the third illustrative embodiment is described in detail below.

Inorganic fine particles such as hydrophobized silica and titanium oxides are externally added to the colored toner and the light-colored toner used in the third illustrative embodiment. The colored toner includes hydrophobized silica in an amount of 1.5 parts by weight based on 100 parts by weight of toner particles. The light-colored toner includes hydrophobized silica in an amount of 0.7 parts by weight based on 100 parts by weight of toner particles. The colored toner includes titanium oxides in an amount of 1.0 part by weight based on 100 parts by weight of toner particles. The light-colored toner includes titanium oxides in an amount of 0.5 parts by weight based on 100 parts by weight of toner particles. It is to be noted that colorants are eliminated from the colored toner used in the third illustrative embodiment to provide the light-colored toner used in the third illustrative embodiment.

It is known that a large coverage of the inorganic fine particles on the surface of the toner reduces adherence of the toner, and the toner temporarily transferred onto the intermediate transfer belt 7 tends not to be transferred onto the sheet P when the toner has strong adherence to the intermediate transfer belt 7. Therefore, the colored toner and the light-colored toner used in the third illustrative embodiment are prepared as described above such that adherence of the light-colored toner temporarily transferred onto the intermediate transfer belt 7 to the intermediate transfer belt 7 is stronger than that of the colored toner temporarily transferred onto the intermediate transfer belt 7 to the intermediate transfer belt 7. As a result, the light-colored toner on the intermediate transfer belt 7 tends not to be transferred onto the sheet P compared to the colored toner on the intermediate transfer belt 7.

A description is now given of a fourth illustrative embodiment of the present invention. A configuration and operations of the image forming apparatus 100 according to the fourth illustrative embodiment are the same as those according to the first illustrative embodiment, and descriptions thereof are omitted. In the fourth illustrative embodiment, an amount of charge of the clear toner transferred onto the intermediate transfer belt 7 is set larger than that of the colored toner transferred onto the intermediate transfer belt 7.

As described previously, in the first illustrative embodiment, the clear toner image T formed on the intermediate transfer belt 7 is caused not to be transferred onto the sheet P together with the colored toner images in order to prevent changes in glossiness and color of a resultant color image. However, a relation between the amounts of charge of the clear toner and the colored toner transferred onto the intermediate transfer belt 7 respectively is not restricted in the first illustrative embodiment.

In addition to the configuration according to the first illustrative embodiment in which the amount of clear toner attached to the intermediate transfer belt 7 is adjusted such that the clear toner image T is not transferred onto the sheet P from the intermediate transfer belt 7, the amount of charge of the clear toner attached to the intermediate transfer belt 7 is set larger than that of the colored toner attached to the intermediate transfer belt 7. Accordingly, the clear toner transferred onto the intermediate transfer belt 7 is reliably prevented from being transferred onto the sheet P, and a deterioration in glossiness and color reproducibility caused by the clear toner can be prevented.

The reason why the amount of charge of the clear toner set higher than that of the colored toner can more reliably prevent the clear toner from being transferred onto the sheet P from the intermediate transfer belt 7 is as follows.

As is clear from a relation among an amount of charge of the toner, a size of a transfer bias, and transfer efficiency, an optimal value of the secondary transfer bias applied to the secondary transfer device 8 for transferring the full-color toner image from the intermediate transfer belt 7 onto the sheet P depends on an amount of charge of the toner.

Therefore, in the fourth illustrative embodiment, the secondary transfer bias applied to the secondary transfer device 8 for transferring the full-color toner image from the intermediate transfer belt 7 onto the sheet P is set to be optimal for the amount of charge of the colored toner. Accordingly, a bias for transferring the clear toner having the amount of charge higher than that of the colored toner is not sufficient, thereby reducing transfer efficiency of the clear toner compared to that of the colored toner. As a result, the clear toner transferred onto the intermediate transfer belt 7 is reliably prevented from being transferred onto the sheet P, and a deterioration in glossiness and color reproducibility caused by the clear toner can be prevented.

It is to be noted that, in the same manner as the first illustrative embodiment, a color of the toner image formed by the image forming unit 12*a*, that is, the clear toner image T, is not particularly limited to be clear, and for example, a toner image of a lighter color may be formed. The reason is that, as described in detail later, the clear toner image T formed by the image forming unit 12*a* illustrated in FIG. 1 is not transferred onto the sheet P according to the fourth illustrative embodiment. However, because there is a possibility that a slight amount of the clear toner image T is transferred onto the sheet P, the color of the clear toner image T needs to be lighter to make that color invisible when being fixed onto the sheet P by the fixing device 10. How to set the amount of charge of the clear toner or the light-colored toner transferred onto the intermediate transfer belt 7 larger than that of the colored toner is described in detail below using the light-colored toner.

Figure 16:
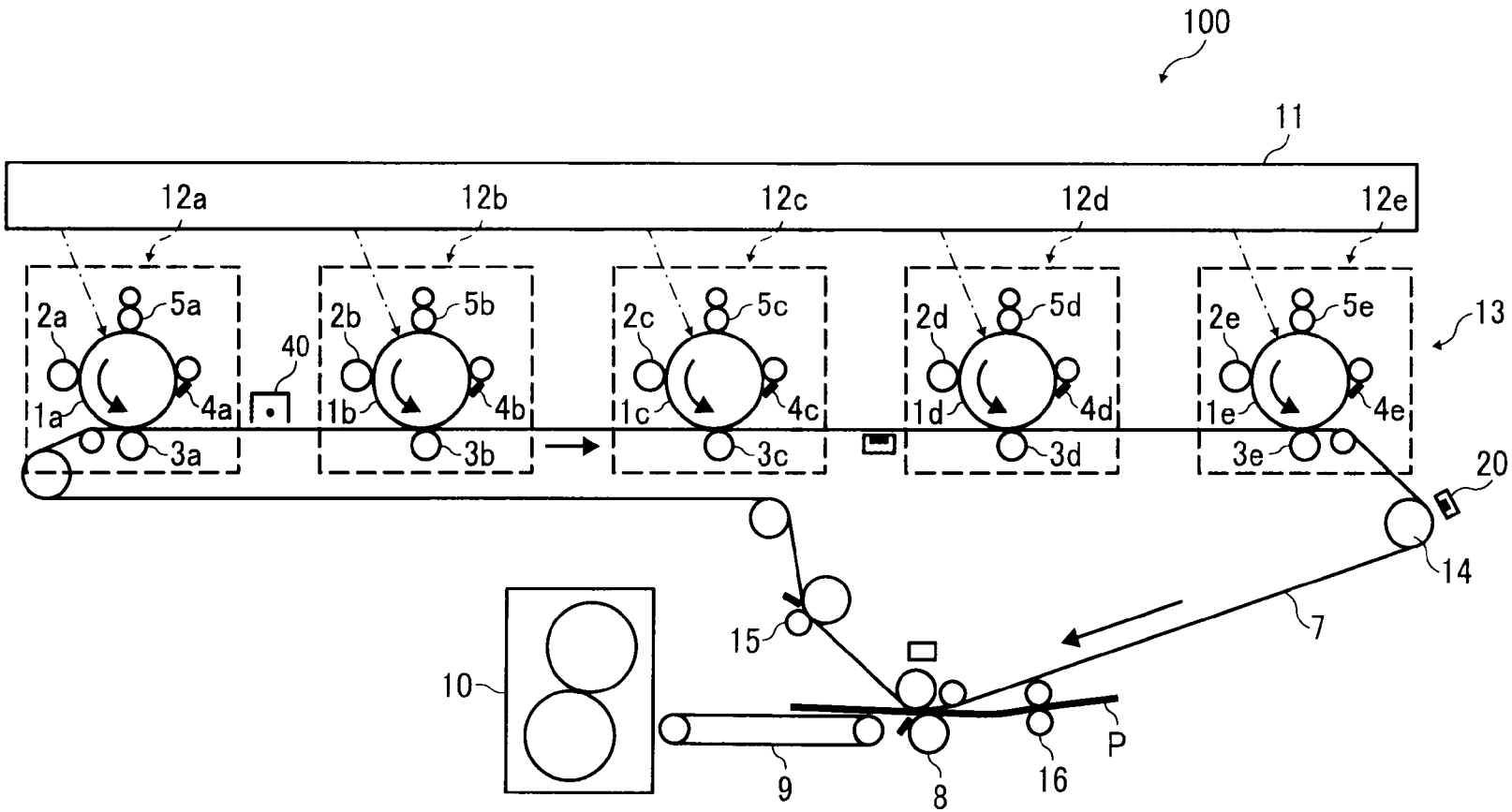
FIG. 16 is a schematic view illustrating a configuration of main components of an image forming apparatus according to a fourth illustrative embodiment.

FIG. 16 is a schematic view illustrating a configuration of main components of the image forming apparatus according to the fourth illustrative embodiment. The image forming apparatus 100 according to the fourth illustrative embodiment includes the primary transfer roller 3*a* serving as a first primary transfer means for transferring a light colored toner image (or the clear toner image T) onto the intermediate transfer belt 7, and the primary transfer rollers 3*b*, 3*c*, 3*d*, and 3*e* each serving as a second primary transfer means for transferring the colored toner images onto the intermediate transfer belt 7. A size of a transfer bias a applied to the first primary transfer means is set larger than sizes of each of transfer biases b, c, d, and e applied to the second primary transfer means, respectively.

It is known that the larger the transfer bias applied to the primary transfer means is, the higher the amount of charge of the toner after being transferred onto the intermediate transfer belt 7 is. Therefore, in the fourth illustrative embodiment, the primary transfer bias a applied to the light-colored toner image is set higher than each of the primary transfer biases b, c, d, and e applied to the colored toner images, thereby setting an amount of charge of the light-colored toner image transferred onto the intermediate transfer belt 7 higher than an amount of charge of the colored toner images transferred onto the intermediate transfer belt 7.

Alternatively, a charge applicator may be provided downstream from the first primary transfer means and upstream from the second primary transfer means in the direction of rotation of the intermediate transfer belt 7 to apply charges to the light-colored toner images transferred onto the intermediate transfer belt 7. Specifically, as illustrated in FIG. 16, a corotron charger 40 for applying charges to the light-colored toner image on the intermediate transfer belt 7 is provided between the primary transfer roller 3*a* serving as the first primary transfer means and the primary transfer roller 3*b* serving as the second primary transfer means.

The corotron charger 40 applies additional charges to the light-colored toner image transferred onto the intermediate transfer belt 7, thereby setting the amount of charge of the light-colored toner image on the intermediate transfer belt 7 higher than that of the colored toner image on the intermediate transfer belt 7.

It is to be noted that the charge applicator is not limited to the corotron charger 40. For example, a charging roller may be used as the charge applicator. In the similar manner as the corotron charger 40, the charging roller may be provided between the image forming units 12*a* and 12*b*.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

multiple colored toner image forming units to form multiple colored toner images on a rotatable body;

a transfer device to collectively transfer the multiple colored toner images onto a recording medium from the rotatable body;

a fixing device to fix the multiple colored toner images onto the recording medium;

a light-colored toner image forming unit provided upstream from the multiple colored toner image forming units in a direction of rotation of the rotatable body to form a light-colored toner image having a color lighter than colors of the multiple colored toner images as a bottommost layer of a resultant full-color toner image formed on the rotatable body, wherein the multiple colored toner images respectively formed by the multiple colored toner image forming units are sequentially superimposed on the light-colored toner image formed by the light-colored toner image forming unit as the bottommost layer of the resultant full-color toner image formed on the rotatable body, a first condition is defined by forming the light-colored toner image such that the light-colored toner image is not transferred onto the recording medium by the transfer device, a second condition is defined by forming the light-colored toner image such that the light-colored toner image is partially transferred onto the recording medium by the transfer device, and one of the first and second conditions is selected based on whether glossiness is required in an image to be formed.

2. The image forming apparatus according to claim 1, wherein forming the light-colored toner image includes changing an amount of toner of the light-colored toner image transferred onto the rotatable body.

3. The image forming apparatus according to claim 1, wherein forming the light-colored toner image includes changing an amount of toner of the light-colored toner image transferred onto the rotatable body depending on a total amount of toner including light-colored toner and colored toner transferred onto the rotatable body.

4. The image forming apparatus according to claim 3, wherein the amount of toner of the light-colored toner image transferred onto the rotatable body is 10% or less of the total amount of toner transferred onto the rotatable body.

5. The image forming apparatus according to claim 1, wherein light-colored toner used for forming the light-colored toner image is clear toner that becomes invisible after being fixed onto the recording medium by the fixing device.

6. The image forming apparatus according to claim 5, wherein the one of the first and second conditions is selected based on image data included in an image to be formed, the image data including colored toner image data for forming the colored toner images and light-colored toner image data for forming the light-colored toner image.

7. The image forming apparatus according to claim 6, wherein the first condition is selected to form the light-colored toner image at a portion of the image having the colored-toner image data.

8. The image forming apparatus according to claim 6, wherein the second condition is selected to form the light-colored toner image at a portion of the image having the light-colored toner image data.

9. The image forming apparatus according to claim 6, wherein either the first or second condition is selected to form the light-colored toner image at a portion of the image having the light-colored toner image data depending on a total amount of toner including light-colored toner and colored toner transferred onto the rotatable body.

10. The image forming apparatus according to claim 9, wherein the second condition is selected to form the light-colored toner image in a case in which the total amount of toner transferred onto the rotatable body does not exceed a predetermined threshold value.

11. The image forming apparatus according to claim 9, further comprising a sheet re-feeding device to re-feed the recording medium discharged from the fixing device to the transfer device without reversing the recording medium, wherein, in a case in which the total amount of toner transferred onto the rotatable body exceeds a predetermined threshold value, the light-colored toner image is formed under the first condition to transfer the multiple colored toner images formed on the light-colored toner image onto the recording medium by the transfer device and to fix the multiple colored toner images onto the recording medium by the fixing device, and the recording medium discharged from the fixing device is re-fed to the transfer device by the sheet re-feeding device to transfer the light-colored toner image formed under the second condition onto the recording medium by the transfer device.

12. The image forming apparatus according to claim 5, wherein the first condition defines changing an amount of toner of the light-colored toner image transferred onto the rotatable body.

13. The image forming apparatus according to claim 12, wherein the first condition defines changing the amount of toner of the light-colored toner image transferred onto the rotatable body depending on a total amount of toner including light-colored toner and colored toner transferred onto the rotatable body.

14. The image forming apparatus according to claim 13, wherein the first condition defines that the amount of toner of the light-colored toner image transferred onto the rotatable body is 10% or less of the total amount of toner transferred onto the rotatable body.

15. The image forming apparatus according to claim 1, wherein:

inorganic fine particles are included in colored toner used for forming the multiple colored toner images and light-colored toner used for forming the light-colored toner image, respectively; and a percentage by weight of the inorganic fine particles included in the light-colored toner is smaller than a percentage by weight of the inorganic fine particles included in the colored toner.

16. The image forming apparatus according to claim 1, further comprising:

a first primary transfer unit to transfer the light-colored toner image onto the rotatable body; and a second primary transfer unit to transfer the multiple colored toner images onto the rotatable body, wherein a transfer bias applied to the first primary transfer unit is higher than a transfer bias applied to the second primary transfer unit.

17. The image forming apparatus according to claim 1, further comprising:

a first primary transfer unit to transfer the light-colored toner image onto the rotatable body;

a second primary transfer unit to transfer the multiple colored toner images onto the rotatable body; and a charge applicator provided downstream from the first primary transfer unit and upstream from the second primary transfer unit in the direction of rotation of the rotatable body to apply charges to toner transferred onto the rotatable body.

* * * * *